US012435402B2

(12) United States Patent
Hatano et al.

(10) Patent No.: US 12,435,402 B2
(45) Date of Patent: Oct. 7, 2025

(54) AUSTENITIC STAINLESS STEEL MATERIAL

(71) Applicant: NIPPON STEEL STAINLESS STEEL CORPORATION, Tokyo (JP)

(72) Inventors: Masaharu Hatano, Tokyo (JP); Kazuhisa Matsumoto, Tokyo (JP); Mitsuki Matsumoto, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 614 days.

(21) Appl. No.: 17/787,972

(22) PCT Filed: Jan. 8, 2021

(86) PCT No.: PCT/JP2021/000422
§ 371 (c)(1),
(2) Date: Jun. 22, 2022

(87) PCT Pub. No.: WO2021/141099
PCT Pub. Date: Jul. 15, 2021

(65) Prior Publication Data

US 2023/0047414 A1 Feb. 16, 2023

(30) Foreign Application Priority Data

Jan. 9, 2020 (JP) ..... 2020-001834

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/58* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search
CPC ..... C22C 38/58; C22C 38/001; C22C 38/002; C22C 38/005; C22C 38/02; C22C 38/06; C22C 38/42; C22C 38/44; C22C 38/46; C22C 38/48; C22C 38/50; C22C 38/52; C22C 38/54; C21D 8/0278; C21D 2211/001; C21D 8/0205; C21D 8/0226; C21D 8/0236; C21D 8/0273; C21D 8/0294; C21D 8/105; C21D 6/004; C21D 9/46; C23G 1/085; C23G 1/086; Y02E 60/32; Y02E 60/36; Y02E 60/50; C23C 8/14
USPC ..... 420/38
See application file for complete search history.

(56) References Cited

U.S. PATENT DOCUMENTS

| | | |
|---|---|---|
| 2020/0131610 A1 | 4/2020 | Matsumoto et al. |
| 2021/0001303 A1 | 1/2021 | Sera et al. |

FOREIGN PATENT DOCUMENTS

| | | |
|---|---|---|
| CN | 110462082 | 11/2019 |
| JP | 2019-143227 | 8/2019 |
| JP | 2019-143228 | 8/2019 |
| TW | 201938848 | 10/2019 |
| WO | 2018/180788 | 10/2018 |

OTHER PUBLICATIONS

Teraoka Shinichi et.al. [JP2003013181A] (Machine translation) (Year: 2003).*

* cited by examiner

*Primary Examiner* — Sally A Merkling
*Assistant Examiner* — Nazmun Nahar Shams
(74) *Attorney, Agent, or Firm* — Birch, Stewart, Kolasch & Birch, LLP

(57) ABSTRACT

An austenitic stainless steel material that has a passivation film on a surface is provided. The austenitic stainless steel material has a chemical composition consisting of, in mass %, C: 0.10% or less, Si: 1.0% or less, Mn: 8.0-10.0%, P: 0.030% or less, S: 0.003% or less, Cr: 15.0-18.0%, Ni: 7.0-9.0%, N: 0.15-0.25%, Al: 0.005-0.20%, Ca: 0.0005-0.01%, Cu: less than 1.0%, Mo: less than 1.0%, B: 0-0.0050%, Nb: 0-0.50%, Ti: 0-0.50%, V: 0-0.50%, W: 0-0.50%, Zr: 0-0.50%, Co: 0-0.50%, Mg: 0-0.005%, Ga: 0-0.005%, Hf: 0-0.10%, REM: 0-0.10%, and the balance: Fe and impurities. An f value, namely, [Ni+0.72Cr+0.88Mo+1.11Mn−0.27Si+0.53Cu+12.93C+7.55N], is more than 29.5 and less than 32.5.

9 Claims, No Drawings

AUSTENITIC STAINLESS STEEL MATERIAL

TECHNICAL FIELD

The present invention relates to an austenitic stainless steel material.

BACKGROUND ART

In recent years, hydrogen energy has been attracting attention as a clean energy that does not emit greenhouse gases such as carbon dioxide. In order to utilize hydrogen energy, there is a need to establish hydrogen-related technologies such as those relating to production, storage, and transmission of hydrogen.

On the other hand, there are various problems involved in establishing hydrogen-related technologies. One of these is the problem of hydrogen embrittlement. Hydrogen energy uses hydrogen gas as a fuel source. Therefore, for example, when a metal material is used in related equipment such as hydrogen production equipment or storage equipment, the problem of so-called "hydrogen embrittlement" arises in which the material is embrittled due to hydrogen gas.

From the viewpoints of production cost, strength, and corrosion resistance, austenitic stainless steel is available as one metal material for use in the related equipment. Therefore, in order to suppress hydrogen embrittlement, austenitic stainless steels having improved hydrogen gas embrittlement (HGE) resistance are being developed.

As one example, Patent Documents 1 and 2 disclose austenitic stainless steels which are excellent in hydrogen embrittlement resistance characteristics at low temperatures. In the austenitic stainless steels disclosed in Patent Documents 1 and 2, the hydrogen embrittlement resistance characteristics are improved by adjusting the chemical compositions to predetermined amounts.

LIST OF PRIOR ART DOCUMENTS

Patent Document

Patent Document 1: JP2019-143227A
Patent Document 2: JP2019-143228A
Patent Document 3: WO 2018/180788

SUMMARY OF INVENTION

Technical Problem

When manufacturing the aforementioned hydrogen-related equipment, the need arises to bond members or components. Therefore, in some cases, the austenitic stainless steel used as a starting material is required to have not only HGE resistance, but also weldability.

Patent Document 3 discloses an austenitic stainless steel for hydrogen that is excellent in weldability. In the steel disclosed in Patent Document 3, hydrogen resistance is enhanced by containing a certain amount of Ni, Cu, and the like, and the contents of S, P, Ca, Al and the like, which affect weldability, are adjusted. By this means, the weldability and hydrogen resistance of the steel are improved.

In this connection, when manufacturing hydrogen-related equipment, in some cases, diffusion bonding is used, and not welding. The reason is that bonding by welding is accompanied by a significant change in shape, while changes in shape can be suppressed when diffusion bonding is performed. This is because, in the case of welding, the starting material is melted, re-solidified, and bonded, whereas in the case of diffusion bonding, at a temperature below the melting point, pressure is applied to an extent such that plastic deformation does not occur as much as possible, and the diffusion of atoms between interfaces is utilized to perform bonding. Therefore, diffusion bonding is suitable for producing equipment for which dimensional accuracy and the like is required.

However, in Patent Documents 1 to 3 which disclose the aforementioned austenitic stainless steels, diffusion bonding is not mentioned. Therefore, in a case where the stainless steels are bonded by diffusion bonding, there is a possibility that an appropriate bonding strength will not be obtained, and good diffusion bonding tolerance will not be obtained.

An objective of the present invention is to solve the problem described above, and provide an austenitic stainless steel material that is excellent in HGE resistance and diffusion bonding properties.

Solution to Problem

The present invention has been made to solve the problem described above, and the gist of the present invention is an austenitic stainless steel material described in the following.

(1) An austenitic stainless steel material, which has a passivation film on a surface, including:

a chemical composition consisting of, in mass %,
C: 0.10% or less,
Si: 1.0% or less,
Mn: 8.0 to 10.0%,
P: 0.030% or less,
S: 0.0030% or less,
Cr: 15.0 to 18.0%,
Ni: 7.0 to 9,0%,
N: 0.15 to 0.25%,
Al: 0.005 to 0.20%,
Ca: 0.0005 to 0.01%,
Cu: less than 1.0%,
Mo: less than 1.0%,
B: 0 to 0.0050%,
Nb: 0 to 0.50%,
Ti: 0 to 0.50%,
V: 0 to 0.50%,
W: 0 to 0.50%,
Zr: 0 to 0.50%,
Co: 0 to 0.50%,
Mg: 0 to 0.005%,
Ga: 0 to 0.010%,
Hf: 0 to 0.10%,
REM: 0 to 0.10%, and
the balance: Fe and impurities,
wherein:

an f value calculated by Formula (i) below is more than 29.5 and less than 32.5;

$$f\ value = Ni + 0.72Cr + 0.88Mo + 1.11Mn - 0.27Si + 0.53Cu + 12.93C + 7.55N \quad (i)$$

where, each symbol of an element in Formula (i) above represents a content (mass %) of the corresponding element contained in the steel, with a value of a symbol being taken as zero if the corresponding element is not contained.

(2) The austenitic stainless steel material according to (1) above, wherein:

the chemical composition contains one or more kinds of element selected from, in mass %, B: 0.0002 to 0.050%,
Nb: 0.01 to 0.50%,
Ti: 0.01 to 0.50%,
V: 0.01 to 0.50%,
W: 0.001 to 0.50%,
Zr: 0.01 to 0.50%,
Co: 0.01 to 0.50%,
Mg: 0.0001 to 0.005%,
Ga: 0.001 to 0.010%,
Hf: 0.01 to 0.10%, and
REM: 0.01 to 0.10%.

(3) The austenitic stainless steel material according to (1) or (2) above, wherein:

cation fractions of a chemical composition in the passivation film satisfy Formula (ii) below:

$$4.5 \leq (Mn+Fe)/Cr < 9.0 \quad \text{(ii)}$$

where, each symbol of an element in Formula (ii) above represents a cation fraction (atomic percent) of the corresponding element contained in the passivation film, with a value of a symbol being taken as zero if the corresponding element is not contained.

(4) The austenitic stainless steel material according to any one of (1) to (3) above, wherein:

a shape of the steel material is a sheet.

(5) The austenitic stainless steel material according to any one of (1) to (4) above, wherein:

the austenitic stainless steel material is used for hydrogen production equipment.

Advantageous Effects of Invention

According to the present invention, an austenitic stainless steel material that is excellent in HGE resistance and diffusion bonding properties can be obtained.

DESCRIPTION OF EMBODIMENTS

The present inventors conducted studies regarding an austenitic stainless steel having good HGE resistance and diffusion bonding properties, and obtained the findings described in (a) to (d) below.

(a) When working is applied to an austenite phase which has low stability, an austenite phase region having a high dislocation density and an austenite phase region having a low dislocation density are formed. In the austenite phase region where the dislocation density is high, the austenite phase transforms into strain-induced martensite, and at the same time, starting points for HGE are generated. Therefore, it is desirable to suppress localized increases in dislocation density in the austenite phase by controlling an f value. This is because, by this means, formation of starting points for HGE can be suppressed.

(b) Cu is effective for suppressing localized increases in dislocation density and forming a homogeneous deformation structure of an austenite phase. Therefore, Cu is an effective element for suppressing HGE. On the other hand, if Cu is added excessively, the diffusion bonding properties may decrease. Cu has a relatively low melting point, and in a high temperature, non-oxidizing atmosphere during bonding, Cu is liable to concentrate at the diffusion interface and dissolve. It is considered that this is because at such time a liquid film is formed at the interface, which hinders bonding at the interface.

Therefore, in order to secure HGE resistance, it is desirable to increase the stability of the austenite phase so that the value of the f value falls within an appropriate range, while also limiting the content of Cu to a certain range. Specifically, a method that increases the f value by adjusting the contents of Mn, Ni, and N is desirable.

(c) In addition, to improve the diffusion bonding properties, it is desirable to reduce non-metallic inclusions at the diffusion interface. Diffusion bonding is a method of bonding by utilizing the diffusion of atoms near the diffusion interface. At such time, non-metallic inclusions such as oxides and sulfides hinder interfacial contact, and make bonding difficult. This is because when the non-metallic inclusions are present near the interface, it is necessary to destroy, disperse and reduce the non-metallic inclusions to perform bonding.

In order to reduce non-metallic inclusions near the interface, it is effective to contain very small amounts of Al and Ca. These elements fix O and S by forming inclusions containing O and S inside the steel. As a result, the formation of non-metallic inclusions containing O or S can be suppressed near the interface.

(d) The corrosion resistance of stainless steel is improved by forming a passivation film rich in Cr on the surface. Since the passivation film will serve as a bonding interface, stable reduction of Cr oxides is required even in a low oxygen environment, and hence the diffusion bonding properties are affected. A passivation film that is suitable for diffusion bonding is a passivation film in which Mn and Fe, which are easily reduced in a non-oxidizing atmosphere during diffusion bonding, are concentrated. Therefore, it is desirable to control the composition of the passivation film by controlling the chemical composition and production conditions.

The present invention has been made based on the above findings, and an austenitic stainless steel material according to the present invention has a passivation film on a surface thereof. The respective requirements of the present invention are described in detail hereunder.

1. Chemical Composition

The reasons for limiting each element are as follows. Note that, in the following description, unless specifically stated otherwise, the symbol "%" with respect to content means "mass percent". Further, a chemical composition described later is the average chemical composition of the entire steel material.

C: 0.10% or less

C is an effective element for stabilizing the austenite phase, and also contributes to improvement of HGE resistance. However, if C is excessively contained, precipitation of Cr-based carbides at the bonding interface and also precipitation thereof at grain boundaries will be promoted, which will lower the diffusion bonding properties and corrosion resistance. Therefore, the content of C is set to 0.10% or less. The content of C is preferably set to 0.08% or less, and more preferably is set to 0.07% or less. On the other hand, in order to obtain the aforementioned effects, the content of C is preferably set to 0.01% or more. Further, when it is desired to increase the f value and maintain the HGE resistance, the content of C is preferably set to 0.03% or more, and more preferably is set to 0.04% or more.

Si: 1.0% or less

Although Si has a deoxidizing effect, if the content of Si is excessive, Si will form oxides at the bonding interface, thereby lowering the surface cleanliness and reducing the diffusion bonding properties. Therefore, the content of Si is set to 1.0% or less. The content of Si is preferably set to 0.8% or less, more preferably is set to 0.7% or less, and further preferably is set to 0.6% or less. On the other hand, in order to obtain the aforementioned effect, the content of Si is preferably set to 0.1% or more, more preferably is set to 0.2% or more, and further preferably is set to 0.3% or more.

Mn: 8.0 to 10.0%

Mn is an effective element for stabilizing the austenite phase, and also contributes to improvement of the HGE resistance. Further, Mn is also an effective element for concentrating in the passivation film and improving the diffusion bonding properties. Therefore, the content of Mn is set to 8.0% or more. The content of Mn is preferably set to 8.5% or more, and more preferably to 9.0% or more. However, if Mn is excessively contained, Mn will promote formation of the & phase, which is highly susceptible to hydrogen embrittlement, and will reduce the HGE resistance. Therefore, the content of Mn is set to 10.0% or less.

P: 0.030% or less

P is an element that is contained in the steel as an impurity, and may cause non-metallic inclusions to form and reduce the diffusion bonding properties. Therefore, the content of P is made 0.030% or less. The content of P is preferably made 0.025% or less, and more preferably 0.015% or less. However, excessively decreasing the content of P will increase the raw material and production costs. Therefore, the content of P is preferably set to 0.005% or more.

S: 0.0030% or less

S is an element that is contained in the steel as an impurity, and may cause non-metallic inclusions to form and reduce the diffusion bonding properties. Therefore, the content of S is made 0.0030% or less. The content of S is preferably made 0.0020% or less, and more preferably 0.0010% or less. However, excessively decreasing the content of S will increase the production cost. Further, the hot workability will also decrease. Therefore, the content of S is preferably set to 0.0001% or more.

Cr: 15.0 to 18.0%

Cr is an element which is contained in stainless steel in a certain amount, and has an effect of improving corrosion resistance, particularly weather resistance. Therefore, the content of Cr is set to 15.0% or more. However, Cr is a ferrite forming element. Therefore, if Cr is excessively contained, Cr will destabilize the austenite phase and reduce the HGE resistance. Further, an excessive amount of Cr will concentrate in the passivation film, and thereby reduce the diffusion bonding properties. Therefore, the content of Cr is set to 18.0% or less. The content of Cr is preferably set to 17.0% or less, and more preferably is set to 16.0% or less.

Ni: 7.0 to 9.0%

Along with Mn, Ni is an element that is required in order to secure HGE resistance. Therefore, the content of Ni is set to 7.0% or more. However, if an excessive amount of Ni is contained, the production cost will increase. Further, because the recrystallization temperature will rise, the diffusion bonding properties will deteriorate. Therefore, the content of Ni is set to 9.0% or less. The content of Ni is preferably set to 8.5% or less, and more preferably is set to 8.0% or less.

N: 0.15 to 0.25%

Similarly to Mn and Ni, N is an effective element for improving HGE resistance. Therefore, the content of N is set to 0.15% or more. The content of N is preferably set to 0.17% or more. However, if N is excessively contained, inner defects such as blowholes during melting may occur, which reduces the manufacturability. Therefore, the content of N is set to 0.25% or less. The content of N is preferably set to 0.22% or less, and more preferably is set to 0.20% or less.

Al: 0.005 to 0.20%

Al is an element that has a deoxidizing effect, and is an element that is necessary for decreasing O in the steel. In the austenitic stainless steel material according to the present invention, from the viewpoint of diffusion bonding properties, it is desirable to decrease the content of O to 0.003% or less. Thus, since oxide-based non-metallic inclusions can be decreased by the deoxidizing effect, the diffusion bonding properties can be improved by containing Al. Therefore, in order to exert a deoxidizing effect, the content of Al is set to 0.005% or more. The content of Al is preferably set to 0.010% or more, and more preferably is set to 0.020% or more. However, if Al is excessively contained, the effect of forming oxides in the steel will be saturated, and oxides which are difficult to reduce will form at the diffusion interface also. As a result, the diffusion bonding tolerance will decrease. Therefore, the content of Al is set to 0.20% or less. The content of Al is preferably set to 0.10% or less, more preferably is set to 0.05% or less, and further preferably is set to 0.04% or less.

Ca: 0.0005 to 0.01%

Similarly to Al, Ca has a deoxidizing effect, and has an effect that decreases O in the steel. Further, Ca forms sulfides and fixes S in the steel. By forming non-metallic inclusions in the steel in this way, Ca has an effect that decreases non-metallic inclusions at the diffusion interface and thereby improves the diffusion bonding properties. Therefore, the content of Ca is set to 0.0005% or more. The content of Ca is preferably set to 0.001% or more, and more preferably is set to 0.002% or more. However, if Ca is excessively contained, the effect of forming oxides in the steel will be saturated, and oxides which are difficult to reduce will form at the diffusion interface also. As a result, the diffusion bonding tolerance will decrease. Therefore, the content of Ca is set to 0.01% or less. The content of Ca is preferably set to 0.005% or less.

Cu: less than 1.0%

Cu is effective for suppressing localized increases in dislocation density and forming a homogeneous deformation structure of an austenite phase. Therefore, Cu is an effective element for suppressing HGE. However, if Cu is excessively contained, the diffusion bonding properties may decrease. Cu has a relatively low melting point, and in a high temperature, non-oxidizing atmosphere during bonding, Cu is liable to concentrate at the diffusion interface and dissolve. It is considered that this is because at such time a liquid film is formed at the interface, which hinders bonding at the interface. Therefore, the content of Cu is set to less than 1.0%. The content of Cu is preferably set to 0.5% or less, more preferably to 0.3% or less, and further preferably is set to less than 0.05%. However, excessively decreasing the content of Cu will lead to constraints on the melting raw materials, and the production cost will increase. Further, the hot workability will also decrease. Therefore, the content of Cu is preferably set to 0.01% or more.

Mo: less than 1.0%

Mo is an element that is mixed in from raw material such as scrap, but if excessively contained, Mo will promote the formation of a 8 ferritic phase and thus cause the HGE resistance to decrease. Therefore, the content of Mo is set to less than 1.0%. The content of Mo is preferably set to 0.5% or less. On the other hand, excessively decreasing the content of Mo will lead to constraints on the melting raw materials, and the production cost will increase. Therefore, the content of Mo is preferably set to 0.01% or more.

In addition to the elements described above, the chemical composition may also contain one or more kinds of element selected from B, Nb, Ti, V, W, Zr, Co, Mg, Ga, Hf and REM within the ranges described below. The reasons for limiting each element are described below.

B: 0 to 0.0050%

B segregates at crystal grain boundaries, and thereby strengthens the grain boundaries and also makes the grains of the steel material fine. As a result, grain boundary migration during diffusion bonding is promoted, and hence B has an effect of indirectly improving the diffusion bonding properties. B also has an effect of improving the manufacturability. Therefore, B may be contained as necessary. However, if excessively contained, B will cause the recrystallization temperature to increase, and consequently the diffusion bonding properties will deteriorate. Therefore, the content of B is set to 0.0050% or less. The content of B is preferably set to 0.0030% or less. On the other hand, in order to obtain the aforementioned effects, the content of B is preferably set to 0.0002% or more.

Nb: 0 to 0.50%

Nb forms carbides or carbonitrides, and makes the grains of the steel material fine. As a result, grain boundary migration during diffusion bonding is promoted, and hence Nb has an effect of indirectly improving the diffusion bonding properties. Therefore, Nb may be contained as necessary. However, if excessively contained, Nb will cause the recrystallization temperature to increase, and consequently the diffusion bonding properties will deteriorate. Therefore, the content of Nb is set to 0.50% or less. The content of Nb is preferably set to 0.30% or less. On the other hand, in order to obtain the aforementioned effect, the content of Nb is preferably set to 0.01% or more.

Ti: 0 to 0.50%

Ti fixes C and N in the steel, and causes non-metallic inclusions to form in the steel, which decreases non-metallic inclusions at the diffusion interface. Consequently, Ti has an effect of improving the diffusion bonding properties. Therefore, Ti may be contained as necessary. However, if Ti is excessively contained, the effect of forming non-metallic inclusions in the steel will be saturated, and non-metallic inclusions will also form at the diffusion interface. Therefore, the content of Ti is set to 0.50% or less. The content of Ti is preferably set to 0.30% or less. On the other hand, in order to obtain the aforementioned effect, the content of Ti is preferably set to 0.01% or more.

V: 0 to 0.50%

V dissolves or precipitates as carbonitrides in the steel, and has an effect of improving the strength. Therefore, V may be contained as necessary. However, if V is excessively contained, carbonitrides will excessively form, and will cause the diffusion bonding properties and the manufacturability during hot working to decrease. Therefore, the content of V is set to 0.50% or less. The content of V is preferably set to 0.30% or less. On the other hand, in order to obtain the aforementioned effect, the content of V is preferably set to 0.01% or more.

W: 0 to 0.50%

W has an effect of improving the strength and the corrosion resistance. Therefore, W may be contained as necessary. However, if W is excessively contained, the production cost will increase. Therefore, the content of W is set to 0.50% or less. The content of W is preferably set to 0.30% or less. On the other hand, in order to obtain the aforementioned effect, the content of W is preferably set to 0.001% or more.

Zr: 0 to 0.50%

Zr has a deoxidizing effect, and has an effect of improving the diffusion bonding properties by forming oxides. Zr also has an effect of improving corrosion resistance. Therefore, Zr may be contained as necessary. However, if Zr is excessively contained, the toughness and the workability will decrease. Therefore, the content of Zr is set to 0.50% or less. The content of Zr is preferably set to 0.30% or less. On the other hand, in order to obtain the aforementioned effects, the content of Zr is preferably set to 0.01% or more.

Co: 0 to 0.50%

Co has effects of improving corrosion resistance and stabilizing the austenite phase. Therefore, Co may be contained as necessary. However, if Co is excessively contained, the toughness and workability will decrease. Therefore, the content of Co is set to 0.50% or less. The content of Co is preferably set to 0.30% or less. On the other hand, in order to obtain the aforementioned effects, the content of Co is preferably set to 0.01% or more.

Mg: 0 to 0.005%

Because Mg has a deoxidizing effect, Mg forms oxides together with O in the steel. Further, Mg has an effect of decreasing non-metallic inclusions such as oxides at the diffusion interface and thereby improving the diffusion bonding properties. Mg also has an effect of improving hot workability. Therefore, Mg may be contained as necessary. However, if Mg is excessively contained, the effect of forming oxides in the steel will be saturated, and oxides will also form at the diffusion interface. In addition, the production cost will increase and the hot workability will decrease. Therefore, the content of Mg is set to 0.005% or less. The content of Mg is preferably set to 0.003% or less. On the other hand, in order to obtain the aforementioned effects, the content of Mg is preferably set to 0.0001% or more.

Ga: 0 to 0.010%

Ga has an effect of improving hot workability. Therefore, Ga may be contained as necessary. However, if Ga is excessively contained, Ga will cause the manufacturability to decrease. Therefore, the content of Ga is set to 0.010% or less. The content of Ga is preferably set to 0.008% or less. On the other hand, in order to obtain the aforementioned effect, the content of Ga is preferably set to 0.001% or more.

Hf: 0 to 0.10%

Hf has an effect of enhancing the strength and improving the HGE resistance. Further, because Hf refines the grains, it also contributes indirectly to improving the diffusion bonding properties. Therefore, Hf may be contained as necessary. However, if Hf is excessively contained, the workability will decrease. Therefore, the content of Hf is set to 0.10% or less. The content of Hf is preferably set to 0.005% or less. On the other hand, in order to obtain the aforementioned effect, the content of Hf is preferably set to 0.01% or more.

REM: 0 to 0.10%

Because REM has a deoxidizing effect, REM forms oxides together with O in the steel. Further, REM has an effect of decreasing non-metallic inclusions such as oxides at the diffusion interface and thereby improving the diffusion bonding properties. REM also has an effect of improving hot workability and corrosion resistance. Therefore, REM may be contained as necessary. However, if REM is excessively contained, the effect of forming oxides in the steel will be saturated, and oxides will also form at the diffusion interface. In addition, the production cost will increase and the hot workability will decrease. Therefore, the content of REM is set to 0.10% or less. The content of REM is preferably set to 0.05% or less. On the other hand, in order to obtain the aforementioned effects, the content of REM is preferably set to 0.01% or more.

The term "REM" refers to a total of 17 elements including Sc, Y, and lanthanoids, the above term "content of REM"

means the total content of these elements. Industrially, REM is often added in the form of misch metal or the like.

The balance in the chemical composition of the present invention is Fe and impurities. Here, the term "impurities" refers to components which, during industrial production of the steel material, are mixed in from a raw material such as ore or scrap or due to various causes during the production processes, and which are allowed within a range that does not adversely affect the present invention.

2. f value

In the austenitic stainless steel material according to the present invention, an f value calculated as described hereunder is defined as an index which indicates the stability of the austenite phase. Specifically, an f value that is calculated by Formula (i) below is made more than 29.5 and less than 32.5.

$$\text{f value}=\text{Ni}+0.72\text{Cr}+0.88\text{Mo}+1.11\text{Mn}-0.27\text{Si}+0.53\text{Cu}+12.93\text{C}+7.55\text{N} \quad \text{(i)}$$

Where, each symbol of an element in Formula (i) above represents a content (mass %) of the corresponding element contained in the steel, with a value of a symbol being taken as zero if the corresponding element is not contained.

Here, if the f value is 29.5 or less, the stability of the austenite phase will be low, and the HGE resistance will decrease. Therefore, the f value is made more than 29.5.

However, if the f value is 32.5 or more, the recrystallization temperature will rise due to a higher level of alloying, and therefore the diffusion bonding properties will deteriorate. Further, as the level of alloying increases, the raw material cost increases and the manufacturability also decreases. Therefore, the f value is made less than 32.5. From the viewpoint of HGE resistance, diffusion bonding properties, and economic efficiency, the f value is preferably made to fall within the range of 30.0 or more and 31.5 or less.

3. Passivation Film

The austenitic stainless steel material according to the present invention has a passivation film. As mentioned above, the formation state of the passivation film affects the diffusion bonding properties. This is because a portion which the passivation film contacts becomes a diffusion interface that is substantially bonded. Diffusion bonding is performed in a high temperature, non-oxidizing atmosphere. Here, the passivation film is made of oxides and is reduced in a non-oxidizing atmosphere to expose the metal surface, so that diffusion of atoms occurs at the bonding interface, and bonding progresses. Cr oxides are difficult to reduce and stable in a low oxygen environment. Therefore, it is preferable to form a passivation film having a high ratio of Mn and Fe oxides, which is easily reduced under the aforementioned temperature and low oxygen environment. Therefore, cation fractions of elements in the chemical composition in the passivation film preferably satisfy Formula (ii) below.

$$4.5 \leq (\text{Mn}+\text{Fe})/\text{Cr} < 9.0 \quad \text{(ii)}$$

Where, each symbol of an element in Formula (ii) represents a cation fraction (atomic percent) of the corresponding element contained in the passivation film, with a value of a symbol being taken as zero if the corresponding element is not contained.

In the passivation film, when the total cation fraction of Mn and Fe with respect to the cation fraction of Cr, that is, the middle value in Formula (ii) above is less than 4.5, these elements are not sufficiently concentrated in the passivation film, and it will be difficult to sufficiently improve the diffusion bonding properties. Therefore, the middle value of Formula (ii) is preferably made 4.5 or more, more preferably 4.7 or more, further preferably 5.0 or more, and very preferably is made 5.5 or more.

On the other hand, if the middle value of Formula (ii) is 9.0 or more, the manufacturability and corrosion resistance will decrease. Therefore, the middle value of Formula (ii) is preferably made less than 9.0, more preferably is made 8.5 or less, and further preferably is made 8.0 or less.

Here, the cation fraction of each element in the passivation film can be measured by the following procedure. Specifically, the cation fractions are measured using an X-ray photoelectron spectrometer (also called an "XPS"). In the measurement, the X-ray source is the AlKα ray, the incident x-ray energy is 1486.6 eV, and the X-ray detection angle is 90°. The state in which each element is present can be confirmed by detecting spectra near the binding energy. The integrated intensities of the respective spectra can then be measured, and the cation fraction of each element can be obtained by converting the measured integrated intensities to cationic ions excluding the elements C, O, and N. Note that, the term "passivation film" of the steel material in the present invention refers to an oxide film up to 0.01 μm in the plate thickness (thickness) direction from the surface (rolled surface or worked surface). Further, it suffices to measure the cation fractions in the passivation film by adopting a rolled surface or a worked surface at the top and the bottom in the plate thickness direction as surfaces, and measuring a passivation film formed on either one of the surfaces, in the plate thickness direction from the surface.

4. Shape and Application

Although the shape of the austenitic stainless steel material according to the present invention is not particularly limited, for example, the austenitic stainless steel material is preferably a steel plate, and in particular a sheet. Further, the austenitic stainless steel material may be formed in a pipe shape. In the case of a sheet, the sheet thickness is preferably about 0.5 to 5.0 mm, while in the case of a pipe shape, the wall thickness is preferably about 1.0 to 6.0 mm. The austenitic stainless steel material according to the present invention is preferably applied for use in devices for hydrogen, and for example, is suitable for hydrogen production equipment, heat exchangers, hydrogen storage tanks, and pressure vessels.

5. Production Method

The austenitic stainless steel material according to the present invention can be stably produced by the production method described hereunder.

Note that, in the following description, the shape of the steel material is described as a steel plate for the sake of simplification. Steel adjusted to the aforementioned chemical composition is melted and cast by a conventional method to obtain a cast piece to be subjected to hot rolling. Note that, regarding the chemical composition, by containing an optional element that has an effect of refining the crystal, for example, Nb, and/or B, a steel micro-structure having a fine grain size will be formed and grain boundary migration during diffusion bonding will be promoted, and hence it will be easy to improve the diffusion bonding tolerance. Next, hot rolling is performed by a conventional method. Although the conditions during hot rolling are not particularly limited, usually, the heating temperature of the cast piece is preferably set in the range of 1150 to 1270° C., and the rolling reduction is preferably in the range of 60.0 to 99.5%.

Note that after the hot rolling, as necessary, pickling and annealing may be performed. Next, cold rolling is performed. The cold rolling is preferably carried out with a rolling reduction in the range of 40 to 90% to obtain a cold-rolled steel plate (cold-worked material). Subsequently, after cold rolling, preferably annealing is performed in which the cold-rolled steel plate is isothermally maintained for I second to 10 minutes at 900 to 1150° C. to make the steel micro-structure of the cold-rolled steel plate an austenitic structure.

After annealing, preferably a descaling treatment as exemplified by pickling is performed. Cold rolling, annealing, and a descaling treatment may be repeated a plurality of times. Note that, in the descaling treatment, in order to obtain a passivation film satisfying Formula (ii), it is preferable to carry out a treatment by a salt method that is described later and high-pressure water spraying.

In particular, in order to form a passivation film in which Mn and Fe are concentrated and which satisfies Formula (ii), it is preferable to perform a treatment that suppresses enrichment of Cr at the surface. If the usual kind of pickling, for example, immersion in a nitric hydrofluoric acid solution, is performed, a Cr-enriched passivation film will be formed, and it will be difficult to satisfy Formula (ii). Therefore, in order to suppress the enrichment of Cr, it is desirable to suppress the chemical dissolution of the steel plate by pickling, and it is preferable to efficiently remove only oxides (scale). Therefore, it is preferable to perform high-pressure water spraying after performing a treatment by a salt method.

Specifically, in the treatment by a salt method, preferably the steel material is immersed in a mixed salt of sodium hydroxide and sodium sulfate or the like. The mixed salt (hereinafter, also referred to as "salt") at this time is preferably heated to 450 to 550° C., and melted in a melting tank. That is, the temperature of the salt in which the steel material is immersed is preferably set within the range of 450 to 550° C. Further, at this time, the immersion time is preferably set to 5 to 10 seconds. By performing a treatment in this way, it will be easy to remove oxides (scale) containing Cr with high efficiency.

If the temperature of the salt in which the steel material is immersed is less than 450° C., it may be difficult to adequately remove oxides containing Cr. Therefore, the immersion temperature is preferably set to 450° C. or more. In order to promote the reaction between the steel plate and the scale, the immersion temperature is preferably set to more than 500° C. On the other hand, if the immersion temperature is more than 550° C., discoloration and residual salt will be liable to occur on the surface of the steel plate. Therefore, the immersion temperature is preferably set to 550° C. or less.

Similarly, if the immersion time in the salt is less than 5 seconds, it may be difficult to adequately remove oxides containing Cr. Therefore, taking into consideration the reactivity with the scale, the immersion time is preferably set to 5 seconds or more. On the other hand, if the immersion time is too long, discoloration and residual salt will be liable to occur on the surface of the steel plate. Therefore, the immersion time is preferably set to 10 seconds or less.

Thereafter, preferably scale that is mainly composed of Fe and remains on the steel material surface is removed by high-pressure water spraying. At such time, it suffices to set the pressure of the spray to about 1 MPa (10 kgf/cm$^2$), and to set the spray irradiation time to 60 seconds or less.

After the high-pressure water spraying, it is conceivable that Cr may still be concentrated on the surface, and therefore in order to form a passivation film that satisfies Formula (ii), it is preferable to polish and scrape off the surface in which the Cr is concentrated, and thereby form a passivation film in which Mn and Fe are concentrated.

The reason for carrying out the above process is due to a mechanism that is described hereunder. Immediately below the surface and passivation film in which Cr is concentrated, a region arises in which the Cr concentration is lower than in the composition of the base metal, and Mn and Fe are relatively concentrated. Therefore, the surface and passivation film in which Cr is concentrated are scraped off by polishing to expose the region where Mn and Fe are concentrated. Thereafter, preferably these elements are naturally oxidized in the atmosphere to form a passivation film in which Mn and Fe are concentrated.

Note that the polishing is preferably performed within a range up to 10 μm in the vertical direction of the plate thickness from the surface. Whilst the polishing method is preferably mechanical polishing, for example, polishing may also be performed using polishing paper, a polishing grindstone, or the like. Further, a solid abrasive may be used. If necessary, electropolishing may be performed. The surface roughness at this time is preferably adjusted so that the Ra is 0.3 μm or less. The Ra is more preferably 0.1 μm or less. Note that it suffices to measure the surface roughness using a contact type surface roughness measuring machine or the like. It is preferable to thereafter form a passivation film in which Mn and Fe are concentrated.

As described above, in order to obtain a passivation film that satisfies Formula (ii), whilst it is preferable to perform polishing after water spraying, the surface of the steel may be polished in advance before cold rolling. In a case where the surface is polished before cold rolling, polishing after water spraying may be performed or need not be performed. Further, the surface of the steel before cold rolling may be ground and may also be subjected to polishing after water spraying. In this case, the value of the middle value in Formula (ii) can be further increased. In the case of grinding the surface of the steel before cold rolling, it is preferable to grind a range from the surface to 10 to 20 μm in the vertical direction of the plate thickness.

Note that the austenitic stainless steel material according to the present invention is used, for example, for hydrogen production equipment. Hydrogen production equipment is manufactured by the following procedure. Specifically, a flow path for hydrogen is created by etching a sheet of the austenitic stainless steel material according to the present invention. Next, a plurality of the aforementioned sheets are laminated and diffusion bonding is performed. The diffusion bonding is preferably performed in a high temperature, non-oxidizing atmosphere. Specifically, it is desirable to perform the diffusion bonding in an inert gas atmosphere such as an Ar or $N_2$ atmosphere or in a non-oxidizing atmosphere which partially includes an inert gas. The diffusion bonding is preferably performed in a temperature range of 900 to 1200° C., at a degree of vacuum of $10^{-1}$ to $10^{-3}$ Pa. The bonding method may be solid phase diffusion bonding or liquid phase diffusion bonding.

Hereunder, the present invention is described more specifically by way of examples, although the present invention is not limited to these examples.

EXAMPLES

Cast pieces having the chemical compositions listed in Table 1 were cast. Next, the obtained cast pieces were heated in a temperature region of 1230° C., and subjected to hot rolling with a rolling reduction of 98.5%. After hot rolling, annealing and pickling or the like were performed, and cold rolling was performed with a rolling reduction of 75%. Subsequently, after annealing at 1050° C. for 10 seconds, a descaling treatment was performed to produce a steel sheet having a thickness of 1.2 mm. For the descaling treatment, either a treatment by a salt method, immersion in a nitric hydrofluoric acid solution, or both a treatment by a salt method and immersion in a nitric hydrofluoric acid solution was performed. In the treatment by a salt method, a mixed salt composed of sodium hydroxide and sodium sulfate or the like was heated to 520° C., the steel sheet was immersed in the melting tank containing the mixed salt for 5 seconds, and thereafter high-pressure water spraying was performed with a spraying pressure of 1 MPa (10 kgf/cm$^2$) for a spray irradiation time of 30 seconds.

With respect to the example of No. 26 in Table 2, treatment by a salt method was not performed, and a pickling treatment that is usually performed (immersion in a nitric hydrofluoric acid solution) was performed. Further, with respect to No. 27, both a treatment by a salt method and a pickling treatment that is usually performed (immersion in a nitric hydrofluoric acid solution) were performed. In the pickling treatment (immersion in a nitric hydrofluoric acid solution) in No. 26 and No. 27, finishing by pickling was performed by immersion for 60 seconds in a 10% nitric acid-0.5% hydrofluoric acid aqueous solution at 55° C. Here, the symbol "%" with respect to the aqueous solution means mass percent.

Thereafter, for some of the examples, polishing using a grindstone was performed from the front and back surfaces to 10 μm in the vertical direction of the plate thickness to obtain a mirror finish. Further, for some of the examples, the steel plate surface was ground by 10 μm before cold rolling. For all of the examples, thereafter, a passivation film was caused to form in the atmosphere.

TABLE 1

| Steel | Chemical Composition (mass %; balance: Fe and impurities) | | | | | | | | | | | | | | | | | | | | | | f | |
|---|---|---|---|---|---|---|---|---|---|---|---|---|---|---|---|---|---|---|---|---|---|---|---|---|
| Type | C | Si | Mn | P | S | Cr | Ni | N | Al | Ca | Cu | Mo | B | Nb | Ti | V | W | Zr | Co | Mg | Ga | Hl | REM | Value† | |
| A | 0.043 | 0.32 | 9.3 | 0.017 | 0.0003 | 15.3 | 7.6 | 0.16 | 0.032 | 0.003 | 0.01 | 0.02 | — | — | — | — | — | — | — | — | — | — | — | 30.6 | Inventive |
| B | 0.01 | 0.11 | 9.8 | 0.005 | 0.0004 | 15.1 | 7.1 | 0.24 | 0.043 | 0.002 | 0.05 | 0.25 | — | — | — | — | — | — | — | 0.0002 | 0.001 | — | — | 31.0 | Examples |
| C | 0.02 | 0.45 | 8.1 | 0.028 | 0.0001 | 15.8 | 7.8 | 0.18 | 0.195 | 0.002 | 0.21 | 0.15 | — | 0.01 | 0.01 | 0.01 | — | — | 0.49 | — | — | — | — | 29.9 | |
| D | 0.03 | 0.55 | 8.3 | 0.021 | 0.0028 | 17.8 | 8.1 | 0.15 | 0.053 | 0.001 | 0.03 | 0.03 | — | — | — | — | 0.002 | | 0.01 | — | — | — | — | 31.5 | |
| E | 0.03 | 0.65 | 8.4 | 0.019 | 0.0012 | 15.3 | 8.9 | 0.16 | 0.021 | 0.001 | 0.11 | 0.01 | — | — | — | — | — | 0.01 | — | — | — | — | — | 30.7 | |
| F | 0.04 | 0.51 | 8.8 | 0.022 | 0.0008 | 15.5 | 7.5 | 0.24 | 0.005 | 0.0005 | 0.07 | 0.12 | — | — | — | — | — | — | — | — | — | 0.01 | 0.01 | 30.8 | |
| G | 0.062 | 0.54 | 9.3 | 0.015 | 0.0003 | 15.2 | 7.4 | 0.18 | 0.021 | 0.0028 | 0.02 | 0.01 | — | 0.48 | 0.05 | 0.12 | 0.15 | 0.03 | 0.18 | 0.0008 | 0.008 | — | 0.01 | 30.7 | |
| H | 0.094 | 0.63 | 9.1 | 0.022 | 0.0011 | 16.1 | 7.2 | 0.16 | 0.031 | 0.0041 | 0.35 | 0.13 | — | — | 0.47 | 0.09 | — | — | 0.05 | — | 0.005 | 0.02 | — | 31.4 | |
| I | 0.055 | 0.97 | 9.5 | 0.009 | 0.0002 | 15.3 | 7.5 | 0.17 | 0.012 | 0.0094 | 0.05 | 0.08 | — | — | 0.02 | 0.48 | 0.1 | — | 0.15 | 0.0015 | — | — | — | 30.9 | |
| J | 0.06 | 0.28 | 8.6 | 0.011 | 0.0006 | 16.1 | 7.2 | 0.16 | 0.022 | 0.005 | 0.98 | 0.02 | — | 0.03 | 0.01 | 0.12 | — | 0.48 | — | — | 0.009 | — | — | 30.8 | |
| K | 0.05 | 0.31 | 8.2 | 0.013 | 0.0007 | 15.9 | 7.4 | 0.16 | 0.038 | 0.006 | 0.02 | 0.98 | — | — | — | — | 0.49 | — | — | 0.0048 | — | — | 0.09 | 30.7 | |
| L | 0.04 | 0.47 | 9.1 | 0.021 | 0.0003 | 16.7 | 7.7 | 0.16 | 0.029 | 0.003 | 0.21 | 0.03 | — | 0.11 | — | 0.21 | — | — | — | 0.0021 | — | 0.09 | — | 31.6 | |
| M | 0.04 | 0.65 | 8.8 | 0.013 | 0.0002 | 15.3 | 7.2 | 0.16 | 0.011 | 0.002 | 0.02 | 0.02 | — | 0.07 | — | 0.09 | 0.02 | — | 0.12 | — | — | — | — | 29.6 | |
| N | 0.065 | 0.33 | 9.5 | 0.009 | 0.0002 | 15.5 | 8.1 | 0.21 | 0.023 | 0.003 | 0.21 | 0.15 | — | — | 0.01 | 0.06 | 0.05 | — | 0.05 | — | — | — | — | 32.4 | |
| V | 0.043 | 0.32 | 9.3 | 0.018 | 0.0002 | 15.4 | 7.6 | 0.16 | 0.028 | 0.002 | 0.02 | 0.03 | 0.0008 | — | — | — | — | — | — | — | — | — | — | 30.7 | |
| W | 0.02 | 0.45 | 8.1 | 0.027 | 0.0001 | 15.8 | 7.8 | 0.18 | 0.194 | 0.003 | 0.19 | 0.14 | 0.0030 | — | — | — | — | — | — | — | — | — | — | 29.9 | |
| O | 0.057 | 0.52 | 8.9 | 0.016 | 0.0002 | 15.2 | 7.2 | 0.16 | 0.012 | 0.001 | 1.10 * | 0.02 | — | 0.01 | 0.02 | 0.09 | — | — | — | — | — | — | — | 30.4 | Comparative |
| P | 0.058 | 0.51 | 8.8 | 0.017 | 0.0003 | 15.3 | 7.2 | 0.17 | 0.21 * | 0.001 | 0.02 | 0.02 | — | 0.02 | 0.01 | 0.11 | — | — | — | — | — | — | — | 29.9 | Examples |
| Q | 0.055 | 0.49 | 8.9 | 0.018 | 0.0002 | 15.4 | 7.3 | 0.16 | 0.002 * | 0.0002 * | 0.12 | 0.01 | — | 0.02 | 0.01 | 0.07 | — | — | — | — | — | — | — | 30.1 | |
| R | 0.06 | 0.48 | 8.8 | 0.016 | 0.0031 * | 15.3 | 7.2 | 0.17 | 0.035 | 0.001 | 0.01 | 0.02 | — | 0.01 | 0.02 | 0.06 | — | — | — | — | — | — | — | 29.9 | |
| S | 0.055 | 0.51 | 8.5 | 0.013 | 0.0002 | 15.2 | 7.2 | 0.16 | 0.018 | 0.001 | 0.01 | 0.01 | — | 0.01 | 0.02 | 0.05 | — | — | — | — | — | — | — | 29.4 * | |
| T | 0.06 | 0.65 | 9.3 | 0.022 | 0.0003 | 16.8 | 8.3 | 0.18 | 0.015 | 0.001 | 0.03 | 0.01 | — | 0.01 | 0.01 | 0.07 | — | — | — | — | — | — | — | 32.7 * | |
| U | 0.065 | 0.38 | 8.8 | 0.019 | 0.0002 | 15.2 | 6.8 * | 0.16 | 0.023 | 0.001 | 0.16 | 0.21 | — | 0.01 | 0.02 | 0.08 | — | — | — | — | — | — | — | 29.7 | |

* Means that value deviates from requirements defined by present invention.

†f Value = Ni + 0.72Cr + 0.88Mo + 1.11Mn − 0.27Si + 0.53Cu + 12.93C + 7.55N . . . (I)

(Measurement of Cation Fractions)

The cation fractions of Mn, Fe and Cr in each obtained passivation film were measured by the following procedure. Specifically, measurement was performed using an XPS in which the AlKα ray was used as the X-ray source, the incident x-ray energy was set to 1486.8 eV, and the X-ray detection angle was set to 90°. By this means, the state in which each element was present was confirmed by detecting spectra near the binding energy. The cation fraction of each element was calculated by measuring the integrated intensities of the respective spectra, and converting the measured integrated intensities to cationic ions excluding the elements C, O, and N.

(Evaluation of HGE Resistance)

With regard to the HGE resistance, a sheet-shaped tensile test specimen having a parallel portion with a width of 4 mm+0.03 mm and a length of 20 mm+0.01 mm was taken from each obtained steel plate. Next, each tensile test specimen was subjected to a slow strain rate tensile test (hereinafter, referred to simply as "SSRT test") at a strain rate of $5\times10^{-5}$/s in 70 MPa hydrogen and 0.1 MPa nitrogen at −40° C. The tensile fracture strength and tensile fracture elongation were measured for the evaluation of the SSRT test. The HGE resistance was evaluated using a hydrogen embrittlement resistance evaluation value. The hydrogen embrittlement resistance evaluation value can be calculated based on the following equation.

Hydrogen embrittlement resistance evaluation value={(tensile fracture strength or fracture elongation in 70 MPa hydrogen)/(tensile fracture strength or fracture elongation in 0.1 MPa nitrogen)}×100 (%) . . . (a)

In a case where the calculated hydrogen embrittlement resistance evaluation value of the tensile fracture strength was 95% or more and the calculated hydrogen embrittlement resistance evaluation value of the tensile fracture elongation was 80 to 90%, the relevant tensile test specimen was evaluated as having good HGE resistance, and marked with the symbol "O" in Table 2. Similarly, in a case where the calculated hydrogen embrittlement resistance evaluation value of the tensile fracture strength was 95% or more and the calculated hydrogen embrittlement resistance evaluation value of the tensile fracture elongation was more than 90%, the relevant tensile test specimen was evaluated as having even more excellent HGE resistance, and marked with the symbol "@" in Table 2. On the other hand, in a case where the hydrogen embrittlement resistance evaluation value was less than the aforementioned numerical values, the HGE resistance was evaluated as not good, and marked with the symbol "x" in Table 2.

(Evaluation of Diffusion Bonding Properties)

With regard to the diffusion bonding properties, three 50 mm square sheets were prepared from each obtained steel sheet. The three sheets were laminated together, and the temperature was raised to 1150° C. at 300° C./h in a vacuum with a vacuum degree of $1.3\times10^{-2}$ to $1.0\times10^{-3}$ Pa, and thereafter a pressurized state obtained by hot pressing with a contact interfacial pressure of 500 g/mm$^2$ was held for 3 hours to perform diffusion bonding. Structural observation of the obtained bonded body was performed in a manner so that the bonding interface could be observed, and the ratio of the length of non-bonded portions to the total length of the bonding interface was calculated as a percentage (hereinafter, referred to as "diffusion bonding properties evaluation value"). The calculation formula is as follows.

Diffusion bonding properties evaluation value=(total length of non-bonded portions/total length of bonding interface)×100 (%) . . . (b)

In a case where the diffusion bonding properties evaluation value was 30% or less, the relevant tensile test specimen was evaluated as having good diffusion bonding properties, and marked with the symbol "O" in Table 2. Further, in a case where the diffusion bonding properties evaluation value was less than 10%, the relevant tensile test specimen was evaluated as having even more excellent diffusion bonding properties, and marked with the symbol "O" in Table 2. On the other hand, in a case where the diffusion bonding properties evaluation value was more than 30%, the diffusion bonding properties of the relevant tensile test specimen were evaluated as not good, and marked with the symbol "x" in Table 2. Table 2 below shows a summary of the results.

TABLE 2

| | | Production Conditions | | | | Properties | | |
|---|---|---|---|---|---|---|---|---|
| Test No. | Steel Type | With/Without Grinding Before Cold Rolling | With/Without Descaling Treatment By Salt Method | With/Without Polishing After Descaling Treatment | Middle Value of Formula (ii)‡ | HGE Resistance | Diffusion Bonding Properties | |
| 1 | A | Without | With | Without | 4.0 ** | ◎ | ○ | Inventive Examples |
| 2 | A | Without | With | With | 8.2 | ◎ | ◎ | |
| 3 | B | Without | With | With | 7.5 | ◎ | ◎ | |
| 4 | G | Without | With | Without | 4.5 | ◎ | ◎ | |
| 5 | D | Without | With | With | 5.2 | ◎ | ◎ | |
| 6 | E | Without | With | With | 6.8 | ◎ | ◎ | |
| 7 | F | Without | With | With | 6.4 | ◎ | ◎ | |
| 8 | H | Without | With | With | 5.6 | ◎ | ◎ | |
| 9 | I | Without | With | With | 7.2 | ◎ | ◎ | |
| 10 | J | Without | With | With | 5.5 | ◎ | ◎ | |
| 11 | K | Without | With | With | 5.7 | ◎ | ◎ | |
| 12 | L | Without | With | With | 5.3 | ◎ | ◎ | |
| 13 | M | Without | With | With | 7.1 | ○ | ◎ | |
| 14 | N | Without | With | With | 6.1 | ◎ | ◎ | |
| 15 | O * | Without | With | With | 4.0 ** | ◎ | X | Comparative Examples |
| 16 | P * | Without | With | With | 6.5 | ○ | X | |
| 17 | Q * | Without | With | With | 6.6 | ◎ | X | |
| 18 | R * | Without | With | With | 6.6 | ○ | X | |
| 19 | S * | Without | With | With | 6.8 | X | ◎ | |

TABLE 2-continued

| Test No. | Steel Type | Production Conditions: With/Without Grinding Before Cold Rolling | With/Without Descaling Treatment By Salt Method | With/Without Polishing After Descaling Treatment | Middle Value of Formula (ii)‡ | Properties: HGE Resistance | Diffusion Bonding Properties | |
|---|---|---|---|---|---|---|---|---|
| 20 | T * | Without | With | Without | 4.5 | ◎ | X | |
| 21 | U | Without | With | With | 6.7 | X | ◎ | |
| 22 | A | With | With | Without | 4.5 | ◎ | ◎ | Inventive Examples |
| 23 | V | Without | With | Without | 4.5 | ◎ | ◎ | |
| 24 | C | With | With | With | 7.7 | ○ | ◎ | |
| 25 | W | Without | With | With | 7.8 | ○ | ◎ | |
| 26 | A | With | Without (Pickling Only) | With | 4.3 ** | ◎ | ○ | |
| 27 | A | With | With + Pickling | With | 4.0 ** | ◎ | ○ | |

* Means that value deviates from requirements defined by present invention.

** Means that value deviates from preferable range of present invention.

‡$4.5 \leq (Mn + Fe)/Cr < 10.0$ . . . (ii)

In Test Nos. 1 to 14 and 22 to 27 which satisfied the requirements defined by the present invention, the HGE resistance and the diffusion bonding properties were good. Although No. 1 satisfied the requirements of the present invention, No. 1 did not satisfy the requirement defined by Formula (ii), and as a result, the diffusion bonding properties were somewhat inferior compared to other example embodiments of the present invention. In No. 4, the grains became fine due to the effect of adding optional elements, and hence the diffusion bonding properties were improved. In No. 13, No. 24 and No. 25, the f value was a low value of less than 30.0, and consequently the HGE resistance decreases in comparison to other example embodiments of the present invention.

Further, in No. 26, although polishing was performed after grind and descaling before cold rolling, a treatment by a salt method was not performed, and therefore No. 26 did not satisfy Formula (ii) and as a result the diffusion bonding properties were somewhat inferior compared to other example embodiments of the present invention. In No. 27, although a treatment by a salt method was performed, because a pickling treatment was performed thereafter, No. 27 did not satisfy Formula (ii) and as a result the diffusion bonding properties were somewhat inferior compared to other example embodiments of the present invention.

On the other hand, in Test Nos. 15 to 21 which did not satisfy the requirements defined by the present invention, at least one of the HGE resistance and the diffusion bonding properties was not good. In No. 15, the content of Cu did not satisfy the requirement defined by the present invention, and therefore the diffusion bonding properties decreased. In No. 16, the content of Al was excessive, and therefore it is thought that, at the diffusion interface, Al oxides were not reduced and remained as they were, and consequently the diffusion bonding properties decreased.

In No. 17, because the content of Al was low, deoxidation was not sufficiently performed, and non-metallic inclusions formed at the diffusion interface and the diffusion bonding properties deteriorated. In No. 18, the content of S was high, and the amount of non-metallic inclusions increased, and consequently the diffusion bonding properties deteriorated. In No. 19, the f value was below the defined lower limit value, and consequently the HGE resistance decreased. In No. 20, the f value was higher than the defined upper limit value, and consequently the diffusion bonding properties deteriorated due to an increase in the recrystallization temperature. In No. 21, the content of Ni was below the content defined in the present invention, and consequently the HGE resistance decreased.

The invention claimed is:

1. An austenitic stainless steel material, which has a passivation film on a surface, comprising:

a chemical composition consisting of, in mass %,

C: 0.10% or less,

Si: 1.0% or less,

Mn: 8.0 to 10.0%,

P: 0.030% or less,

S: 0.0030% or less,

Cr: 15.0 to 18.0%,

Ni: 7.0 to 9.0%,

N: 0.15 to 0.25%,

Al: 0.005 to 0.20%,

Ca: 0.0005 to 0.01%,

Cu: less than 1.0%,

Mo: less than 1.0%,

B: 0 to 0.0050%,

Nb: 0 to 0.50%,

Ti: 0 to 0.50%,

V: 0 to 0.50%,

W: 0 to 0.50%,

Zr: 0 to 0.50%,

Co: 0 to 0.50%,

Mg: 0 to 0.005%,

Ga: 0 to 0.010%,

Hf: 0 to 0.10%,

REM: 0 to 0.10%, and the balance: Fe and impurities, wherein:

an f value calculated by Formula (i) below is more than 29.5 and less than 32.5;

cation fractions of a chemical composition in the passivation film satisfy Formula (ii) below:

$$f\ value = Ni + 0.72Cr + 0.88Mo + 1.11Mn - 0.27Si + 0.53Cu + 12.93C + 7.55N \quad (i)$$

$$4.5 \leq (Mn+Fe)/Cr < 9.0 \quad (ii)$$

where, each symbol of an element in Formula (i) above represents a content (mass %) of the corresponding element contained in the steel, with a value of a symbol being taken as zero if the corresponding element is not contained, and each symbol of an element in Formula (ii) above represents a cation fraction (atomic percent) of the corresponding element contained in the passivation film, with a value of a symbol being taken as zero if the corresponding element is not contained.

2. The austenitic stainless steel material according to claim 1, wherein:

the chemical composition contains one or more kinds of element selected from, in mass %, B: 0.0002 to 0.0050%,
Nb: 0.01 to 0.50%,
Ti: 0.01 to 0.50%,
V: 0.01 to 0.50%,
W: 0.001 to 0.50%,
Zr: 0.01 to 0.50%,
Co: 0.01 to 0.50%,
Mg: 0.0001 to 0.005%,
Ga: 0.001 to 0.010%,
Hf: 0.01 to 0.10%, and
REM: 0.01 to 0.10%.

3. The austenitic stainless steel material according to claim 1, wherein:

a shape of the steel material is a sheet.

4. The austenitic stainless steel material according to claim 1, wherein:

the austenitic stainless steel material is used for hydrogen production equipment.

5. The austenitic stainless steel material according to claim 2, wherein:

a shape of the steel material is a sheet.

6. The austenitic stainless steel material according to claim 2, wherein:

the austenitic stainless steel material is used for hydrogen production equipment.

7. The austenitic stainless steel material according to claim 3, wherein:

the austenitic stainless steel material is used for hydrogen production equipment.

8. The austenitic stainless steel material according to claim 5, wherein:

the austenitic stainless steel material is used for hydrogen production equipment.

9. An austenitic stainless steel material, which has a passivation film on a surface, comprising:

a chemical composition comprising, in mass %,

C: 0.10% or less,
Si: 1.0% or less,
Mn: 8.0 to 10.0%,
P: 0.030% or less,
S: 0.0030% or less,
Cr: 15.0 to 18.0%,
Ni: 7.0 to 9.0%,
N: 0.15 to 0.25%,
Al: 0.005 to 0.20%,
Ca: 0.0005 to 0.01%,
Cu: less than 1.0%,
Mo: less than 1.0%,
B: 0 to 0.0050%,
Nb: 0 to 0.50%,
Ti: 0 to 0.50%,
V: 0 to 0.50%,
W: 0 to 0.50%,
Zr: 0 to 0.50%,
Co: 0 to 0.50%,
Mg: 0 to 0.005%,
Ga: 0 to 0.010%,
Hf: 0 to 0.10%,
REM: 0 to 0.10%, and
the balance: Fe and impurities, wherein:

an f value calculated by Formula (i) below is more than 29.5 and less than 32.5;

cation fractions of a chemical composition in the passivation film satisfy Formula (ii) below:

$$f\ value = Ni + 0.72Cr + 0.88Mo + 1.11Mn - 0.27Si + 0.53Cu + 12.93C + 7.55N \quad \text{(i)}$$

$$3.5 \leq (Mn+Fe)/Cr < 9.0 \quad \text{(ii)}$$

where, each symbol of an element in Formula (i) above represents a content (mass %) of the corresponding element contained in the steel, with a value of a symbol being taken as zero if the corresponding element is not contained, and each symbol of an element in Formula (ii) above represents a cation fraction (atomic percent) of the corresponding element contained in the passivation film, with a value of a symbol being taken as zero if the corresponding element is not contained.

* * * * *